United States Patent [19]

Barsacq

[11] Patent Number: 4,553,991

[45] Date of Patent: Nov. 19, 1985

[54] CENTRALIZED SUCTION CLEANING INSTALLATIONS

[75] Inventor: Gabriel Barsacq, Biarritz, France

[73] Assignee: S.A.R.L. Aspiramatic, Anglet, France

[21] Appl. No.: 617,277

[22] Filed: Jun. 4, 1984

[30] Foreign Application Priority Data

Jun. 9, 1983 [FR] France ..... 83 09710

[51] Int. Cl.[4] ..... B01D 47/02

[52] U.S. Cl. ..... 55/218; 15/301; 15/353; 55/242; 55/256; 55/274; 55/472; 55/DIG. 8

[58] Field of Search ..... 15/301, 353; 55/218, 55/216, 215, 256, 242, 274, 472, DIG. 8

[56] References Cited

U.S. PATENT DOCUMENTS

| | | | |
|---|---|---|---|
| 1,980,522 | 11/1934 | Hawley | 55/242 X |
| 2,609,190 | 9/1952 | Jackson | 15/301 X |
| 2,673,619 | 3/1954 | Martin | 15/353 X |
| 3,048,875 | 8/1962 | Bottinelli et al. | 15/301 |
| 3,173,164 | 3/1965 | Congdon | 15/353 X |
| 3,286,444 | 11/1966 | Boswinkle et al. | 55/215 |
| 3,537,239 | 11/1970 | Dunmire | 55/242 |

*Primary Examiner*—Kathleen J. Prunner
*Attorney, Agent, or Firm*—Robert J. Koch

[57] ABSTRACT

A centralized suction cleaning installation comprises a network of fixed pipes connected to suction generating means. Air intakes to which said pipes are connected are adapted to have portable cleaning tools coupled to them. An upper end of a first chamber is coupled to the suction generating means. Its lower end is connected to the fixed pipe network and to an evacuation pipe incorporating a first valve. A first storage tank in the lower end of the first chamber is filled with water to the level of the evacuation pipe. Air sucked into the installation is bubbled through the water in this tank. A second water storage tank in a second chamber is connected to a pressurized water supply by a float valve and by a second valve to the first chamber. A three-way solenoid valve connected to the pressurized water supply operates the float valve and the first and second valves. It is controlled by a switch integrated into a hook or other support for the portable tools.

5 Claims, 2 Drawing Figures

CENTRALIZED SUCTION CLEANING INSTALLATIONS

BACKGROUND OF THE INVENTION

1. Field of the Invention

The present invention concerns centralized suction cleaning installations.

2. Description of the Prior Art

This type of installation, so designated by analogy with central heating installations, comprises suction generating means permanently installed at a fixed location, for example in the basement of a dwelling (individual house or shared dwelling) and connected by a system of pipes, also installed in a permanent manner, to the various living rooms or areas. These pipes terminate in the rooms at air intakes integrated into the wall or floor.

The mobile part of the suction system consists of a set of tools, a rigid rube and a suction hose which may be coupled to any of the air intakes in order to clean the corresponding room.

Current installations have a number of disadvantages relating in particular to the systems for removing dust from the air sucked in.

Dust removal is usually effected by a dry method using a cyclone or a wet method in which the air sucked in is drawn across the surface of water in a tank, or by a combination of these two processes. These are not fully effective and necessitate systems which can be complex and expensive for controlling the evacuation of the dust or sludge and for monitoring and supervising the process.

The objective of the invention is to propose for such installations dust removal means which are entirely automatic, simple and reliable and which procure effective dust removal with virtually no requirement for maintenance or supervision.

SUMMARY OF THE INVENTION

The invention consists in a centralized suction cleaning installation comprising suction generating means, a network of fixed pipes connected to said suction generating means, air intakes to which said pipes are connected and which are adapted to have portable cleaning tools coupled to them, means for removing dust from air drawn into the installation, means for evacuating said dust, a closed first chamber, a pipe connecting an upper end of said first chamber to said suction generating means, means connecting a lower end of said first chamber to said fixed pipe network, an evacuation pipe connected to said lower end of said first chamber, a first valve in said evacuation pipe, a first storage tank in said lower end of said first chamber adapted to be filled with water to the level of said evacuation pipe, a bubble arm through which said fixed pipe network is connected to said first chamber and which terminates below the level of said evacuation pipe in said first storage tank, a second water storage tank, a second chamber containing said second water storage tank, a float valve, a pressurized water supply system connected via said float valve to said second chamber, a second valve through which said second chamber is connected to said first chamber, a three-way solenoid valve in said pressurized water supply system connected to said float valve and said first and second valves, and a control switch connected to said solenoid valve.

A system of this kind is particularly effective by virtue of the bubbling of the air sucked in through the water in the first storage tank, this bubbling procuring complete washing of the air sucked in which is in this way totally cleaned of dust and other particles, debris and foreign bodies.

Moreover, the solenoid valve and its control switch are arranged in such a way that operation of said switch on beginning cleaning of the rooms or areas causes the solenoid valve to feed pressurized water to the two aforementioned valves and to the float valve. Consequently, as soon as cleaning operations are begun, the first chamber in which bubbling of the air sucked in takes place is totally isolated from the evacuation network and from the second chamber, which contains rinsing/flushing water and which is immediately filled with water, the supply of water being automatically shut off by the float valve. On the other hand, at the end of cleaning, the switch is again operated to return the solenoid valve to its isolating position which vents to atmosphere the circuits connected to the valves and to the float valve. The valves then open and, by virtue of an entrainment effect, all of the rinsing/flushing water passes into said first chamber and then flows into the evacuation pipe, taking with it the water in which bubbling takes place and the accumulated dust or debris.

At the end of this evacuation there remains in the bottom of the bubbling chamber a reserve of fresh water ready for subsequent washing of the air sucked in.

This system is particularly simple and reliable. It is automatic and requires virtually no maintenance or supervision as there is virtually no risk of clogging.

Other objects and advantages will appear from the following description of an example of the invention, when considered in connection with the accompanying drawings, and the novel features will be particularly pointed out in the appended claims.

DESCRIPTION OF THE PREFERRED EMBODIMENT

Figure 1:
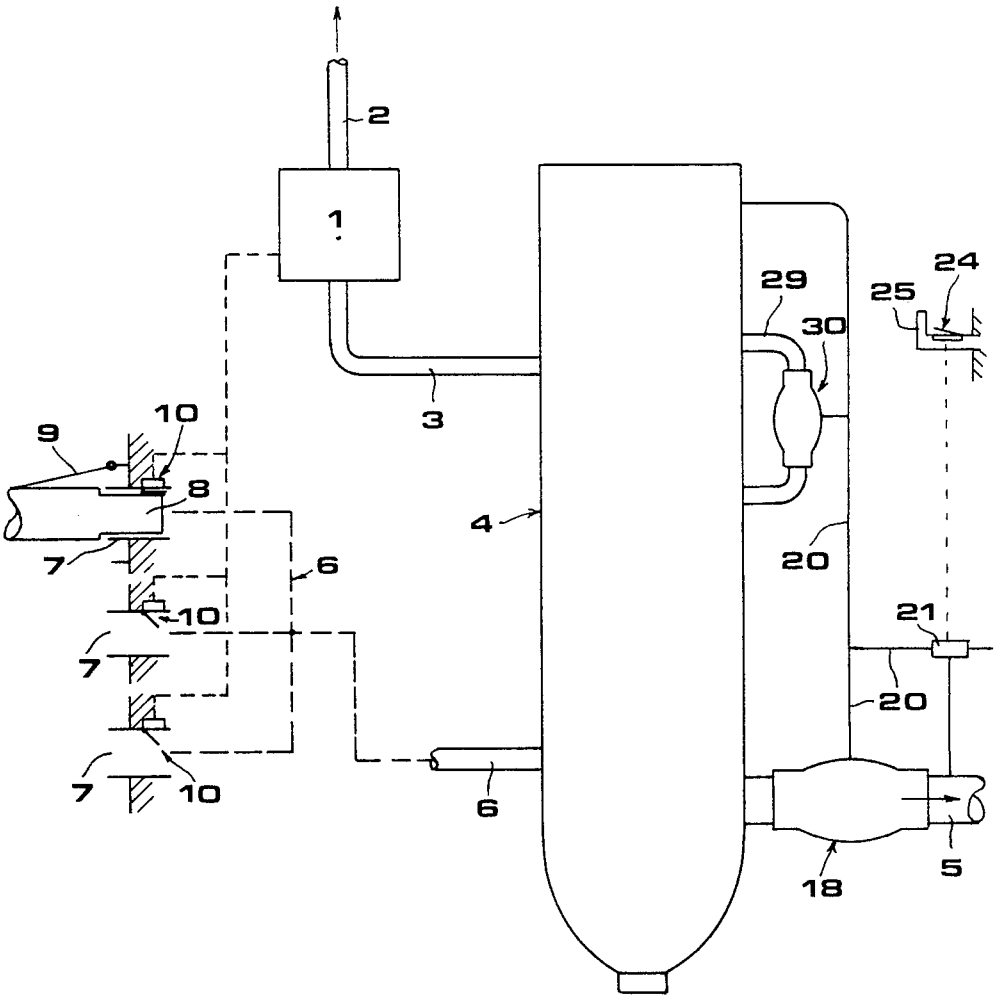
FIG. 1 is a general schematic showing a centralized suction cleaning installation in accordance with the invention.
Figure 1A:
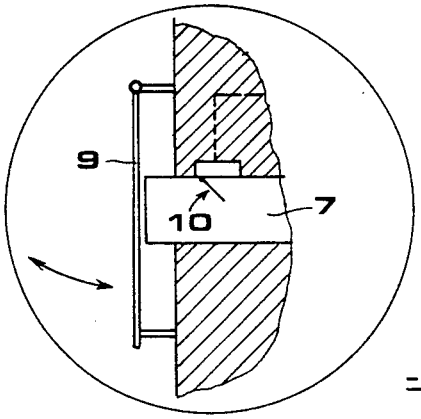

FIG. 1 shows schematically a suction generating turbine 1 connected to an evacuation pipe 2 and, via a pipe 3, to a dust removal unit 4 itself connected by a pipe 5 to a network for evacuation of dust and other debris collected and by a network 6 of pipes to a number of air intakes 7 distributed in various rooms or areas.

All of the units or devices 1 to 7 are permanently installed.

Into each air intake 7 there may be inserted the end of a rigid connector 8 on a flexible hose to the other end of which is fitted an appropriate (removable) suction tool. In the known manner, each intake 7 is equipped with a flap 9 designed to shut off and hide the opening of the intake, and is equipped with a built-in switch 10 electrically connected to the motor of the suction turbine 1.

Figure 2:
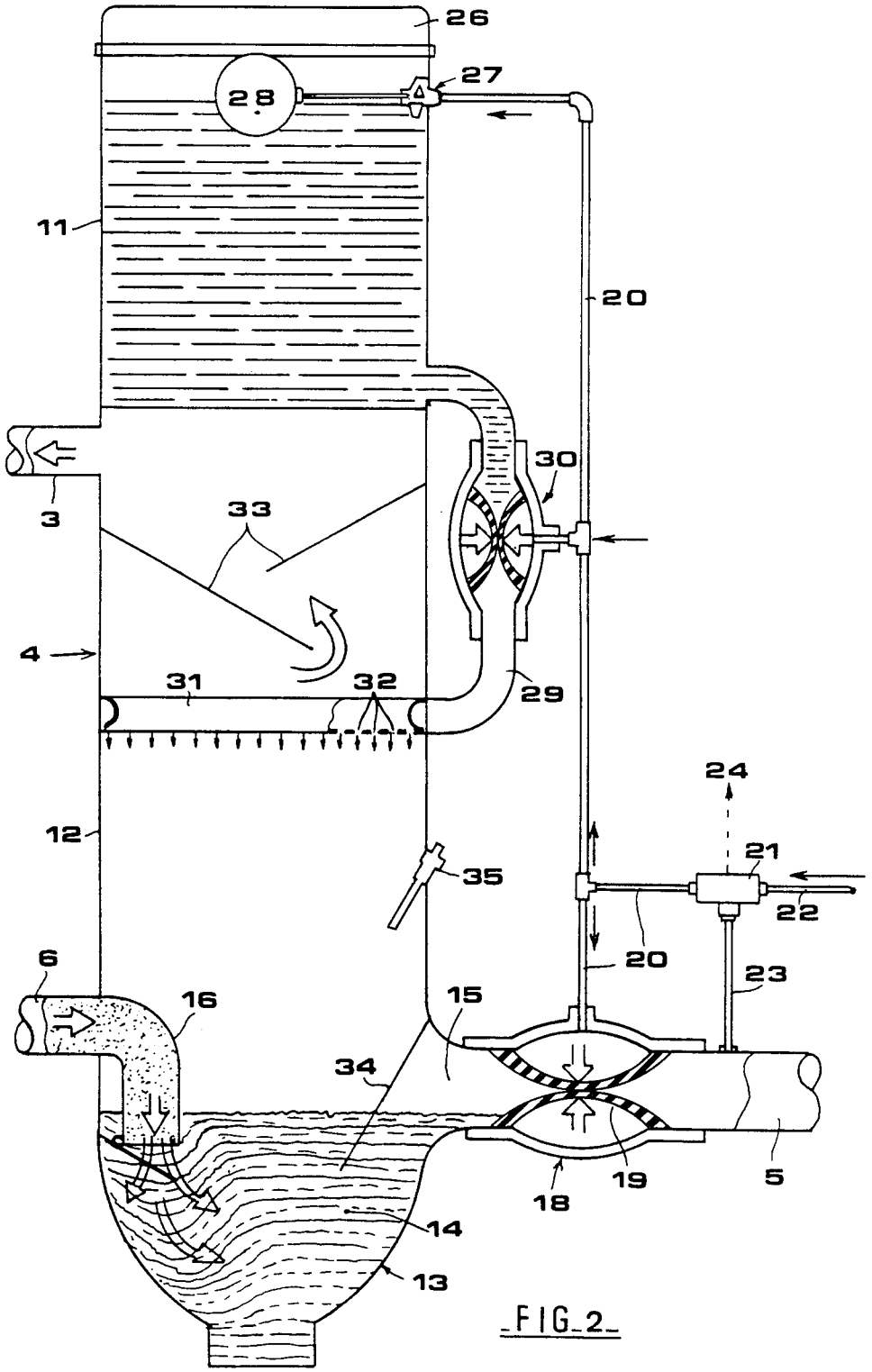
FIG. 2 is a schematic vertical axial cross-section through the dust removal/evacuation means of the installation of FIG. 1.

The dust removal unit 4 comprises (FIG. 2) a vertical cylindrical body defining an upper compartment 11 designed to store rinsing/flushing water and a lower compartment 12 for dust separation/collection. The compartment 12 is connected at its upper end to the suction pipe 3 and at its lower end to the evacuation pipe 5 and to the fixed pipe network 6.

The lower end of the compartment or chamber 12 constitutes a form of bowl 13 filled with water 14 for washing the air sucked in. The surface of this water 14 is level with the evacuation orifice 15 whereas said network 6 extends into the chamber 12 by means of a right-angle bubbler pipe 16 immersed in the water 14.

The bowl 13 is advantageously removable.

Into the evacuation pipe 5 is inserted a valve 18 with a flexible obturator sleeve 19 controlled by pressurised water fed in by a pipe 20 connected to one of the three channels of a solenoid valve 21. A second channel of the solenoid valve 21 is connected to the pressurized water conduit 22 whereas the third channel is connected by a pipe 23 to the evacuation pipe 5.

This type of valve is very well known and there is no requirement for its operation to be further explained.

The solenoid valve 21 is controlled electrically by means of a switch 24 (FIG. 1) integrated into a hook 25 which is used to hang up the mobile parts of the installation (rigid tube, flexible hoses, tools) when the latter are not in used.

The compartment or chamber 11 is accessible through a removable cover 26 and receives water from the pipe 20 through the intermediary of a needle valve 27 operated by a float 28 in the same way as a toilet flushing system.

The compartment 11 communicates with the compartment 12 through a pipe 29 in which is a valve 30 with a flexible obturator sleeve of the same type as the valve 18. The valve 30 is operated from the pipe 20.

The pipe 29 ends at a substantially central location in the chamber 12 in an interior circular pipe 31 the bottom of which is pierced with holes 32.

Above the pipe 31, which forms a kind of shower ring, there are disposed interior baffles 33, whereas another baffle 34 forming a deflector/syphon is situated in line with the evacuation orifice 15.

Finally, a safety level sensor 35 is situated in the chamber 12, substantially halfway between the pipe 31 and the evacuation orifice 15.

OPERATION

The installation as shown and as described hereinabove operates as follows:

The installation is used in exactly the same way as known centralized suction cleaning systems in so far as the connection or disconnection of a suction hose to or from any of the suction intakes 7 is concerned. Plugging in a hose starts the suction turbine 1 through the intermediary of the switch 10, while unplugging it stops the turbine.

However, in accordance with the invention, as soon as the tools necessary for cleaning are taken off the hook 25 the switch 24 operates the solenoid valve 21 so as to place the pipes 20 and 22 in communication.

The valves 18 and 30 then close and the chamber 11 (which is empty at this time) fills with water.

The chamber 12 is thus totally isolated and may be depressurised.

The solenoid valve 21 remains in this position until the suction tools are replaced on the hook 25.

While suction is taking place, the air passes into the pipe 16 and, bubbling through the water 14, is totally cleaned of all traces of dirt, dust, debris, small foreign bodies and the like before exiting the surface of the liquid, crossing the chamber 12 and, after passing through the baffles 33, leaving via the pipe 3.

When the cleaning operations have been completed and the tools replaced on the hook 25, the solenoid valve 21 returns to its initial unoperated position in which the pipes 20 and 23 communicate and pipe 22 is isolated.

The valves 18 and 30 immediately open, the water in the network 20 flowing through the pipe 23 into the evacuation pipe 5.

The water from the compartment 11 flows into the compartment 12 through the pierced ring 32, as in a flushing cistern.

Thus all of the lower part of the compartment 12 is washed and rinsed and all of the water 14 and all the sludge and dirt in it are evacuated through the orifice 15. Finally there remains in the bowl 13 only a reserve of fresh water substituted for the initial reserve 14.

The solenoid valve 21 remains in this state until the next cleaning operation and throughout this interval the valves 18 and 30 remain unoperated and the compartment 11 empty.

This operation is fully automatic and particularly effective since the dust-laden air is fed at high speed into the water 14 and the turbulence resulting from the bubbling action results in complete washing of the air.

The switch 24 (which may be a microswitch, for example) is disposed so as to cut off the supply of current to the solenoid valve 21 when the suction tools are replaced on the hook 25.

Thus when not in use no unit of the installation is either live or pressurized.

The pierced ring 31 procures vigorous rinsing of the walls of the compartment 12.

The device of the invention does not bring about any recycling of the dust since at the end of each cleaning operation the latter is evacuated. It is also remarkably simple, robust and reliable. There is virtually no maintenance as there is no tank to be emptied, no filter to be changed and no clogging to be rectified. Head losses in the suction circuit are minimised and do not increase with time since there is no clogging.

Finally, the turbine 1 is not fouled, increasing its service life.

The level sensor 35 is merely a safety device provided against the extraordinary circumstance of evacuation through the pipe 5 being blocked off.

The installation is shut down should the liquid level rise to the sensor 35.

The bowl 13 incorporates an inspection port for locating any small objects sucked in by mistake, which can be readily recovered through the port.

It will be understood that various changes in the details, materials and arrangements of parts, which have been herein described and illustrated in order to explain the nature of the inventiion may be made by those skilled in the art within the principle and scope of the invention as expressed in the appended claims.

This applies in particular to the means for shutting off the pipes 5 and 29 and the associated control means. Likewise, the switch 24 may be disposed elsewhere and operated otherwise.

The invention is equally applicable to domestic and industrial uses.

There is claimed:

1. Centralized suction cleaning installation comprising suction generating means, a network of fixed pipes connected to said suction generating means, air intakes to which said pipes are connected and which are adapted to have portable cleaning tools coupled to them, means for removing dust from air drawn into the installation, means for evacuating said dust, a closed first chamber, a pipe connecting an upper end of said first chamber to said suction generating means, means connecting a lower end of said first chamber to said fixed pipe network, an evacuation pipe connected to said lower end of said first chamber, a first valve in said evacuation pipe, a first storage tank in said lower end of said first chamber adapted to be filled with water to the level of said evacuation pipe, a bubble arm through which said fixed pipe network is connected to said first chamber and which terminates below the level of said evacuation pipe in said first storage tank, a second water storage tank, a second chamber containing said second water storage tank, a float valve, a pressurized water supply system connected via said float valve to said second chamber, a second valve through which said second chamber is connected to said first chamber, a three-way solenoid valve in said pressurized water supply system connected to said float valve and said first and second valves, and a control switch connected to said solenoid valve.

2. Installation according to claim 1, wherein said first and second valves each comprise a flexible obturator sleeve and further comprising respective pipes connecting said first and second valves to said solenoid valve which is adapted to connect said pipes to said pressurized water supply system when in its operated position and to said evacuation pipe when in its unoperated position.

3. Installation according to claim 1, wherein said switch is integrated into a support adapted to carry mobile tools of the installation when not in use.

4. Installation according to claim 1, further comprising an annular pipe pierced with holes whereby water from said second storage tank is sprayed into said first chamber so as to wash down all of the inside wall of said first chamber.

5. Installation according to claim 1, wherein said lower part of said first chamber comprises a removable bowl which incorporates an inspection port.

* * * * *